United States Patent [19]

Bouhon

[11] 4,073,126

[45] Feb. 14, 1978

[54] OPEN-END SPINNING DEVICE

[75] Inventor: Pierre Hubert Marie Joseph Bouhon, Heusy (Verviers), Belgium

[73] Assignee: Societe Anonyme des Ateliers Houget Duesberg Bosson, Verviers, Belgium

[21] Appl. No.: 727,999

[22] Filed: Sept. 30, 1976

[30] Foreign Application Priority Data

Oct. 3, 1975 Belgium ..... 834173

[51] Int. Cl.[2] ..... D01H 1/12

[52] U.S. Cl. ..... 57/58.95

[58] Field of Search ..... 57/58.89, 58.95

[56] References Cited

U.S. PATENT DOCUMENTS 3,481,128 12/1969 Landwehrkamp et al. .... 57/58.95 X 3,958,403 5/1976 Webling ..... 57/58.89

3,978,646 9/1976 Hoffman et al. ..... 57/58.95

*Primary Examiner*—Richard C. Queisser

*Assistant Examiner*—Charles Gorenstein

[57] ABSTRACT

The invention relates to an open-end spinning device comprising an opening-up member (2) whereby the fibers, which are supplied in the form of a continuous sliver, are disintegrated and then introduced into a spinning turbine rotating at high speed, the yarn extracted from the turbine being discharged through an outlet tube; a funnel-shaped member is secured to the disintegrator (2) and thus rotates at the same speed.

The funnel comprises a hollow element having a top securing flange which extends into the spinning chamber and which, along its central axis, has a tubular head terminating near the outlet tube.

7 Claims, 1 Drawing Figure

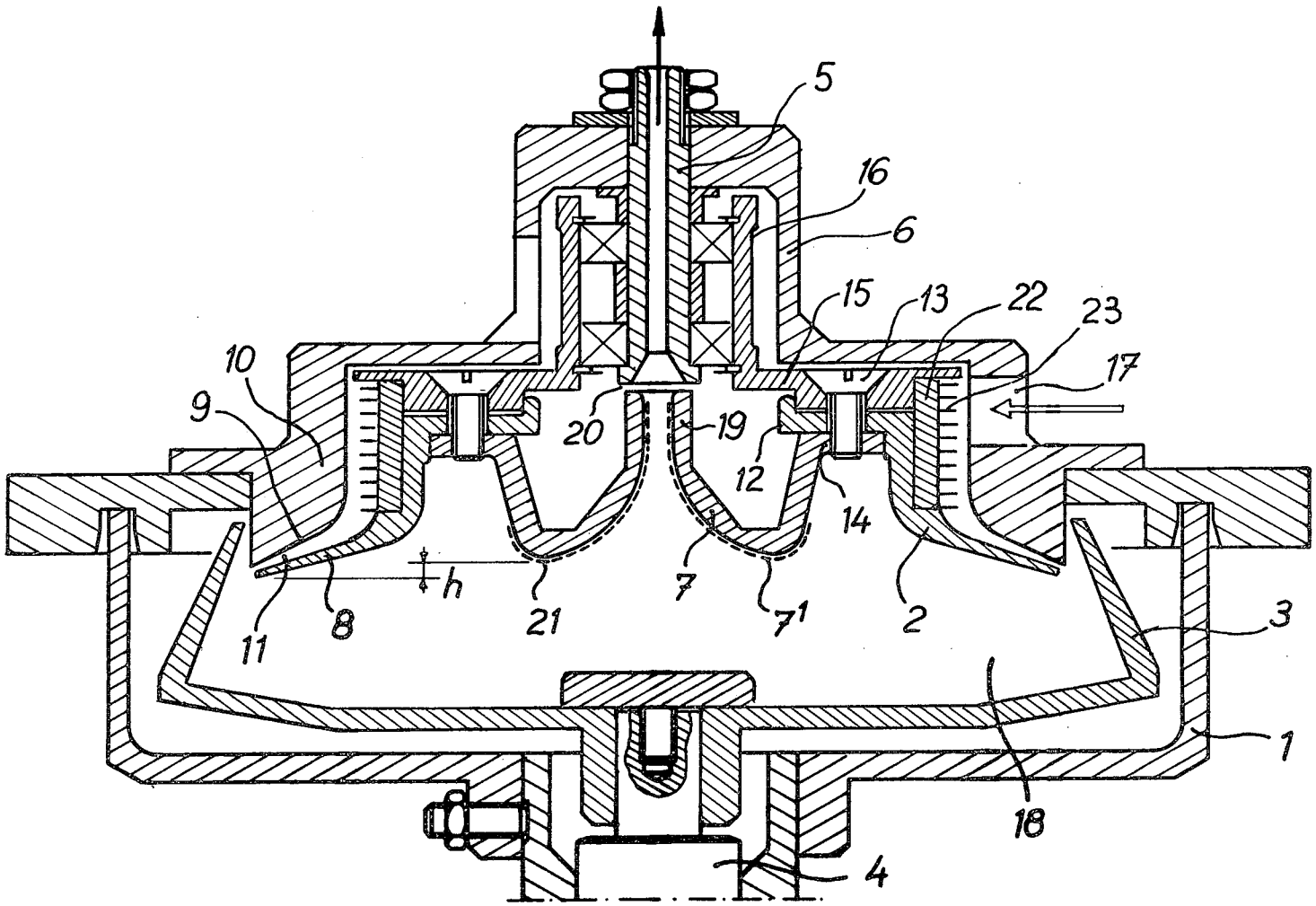
1
2
3
4
5
6
7
7'
8
9
10
11
12
13
14
15
16
17
18
19
20
21
22
23
h

OPEN-END SPINNING DEVICE

The invention relates to an open-end spinning device comprising an opening-up member by which the fibres which are supplied in the form of a continuous sliver are disintegrated and then introduced into a spinning turbine rotating at high speed the yarn extracted from the turbine being discharged through an outlet tube.

Various embodiments have already been suggested comprising cooling means for the funnel-shaped member so that the temperature produced by friction of the yarn on the funnel-shaped member does not exceed a given value which when too high could be detrimental for the fibres.

Experience has shown that substantially more advantageous results can be obtained when the funnel-shaped member is secured to the disintegrator or opening-up member and thus rotates at the same speed.

By the invention, the following results are obtained:

1. The amount of tangling due to the rotation of the yarn on the funnel is greatly reduced, so that the resulting yarn has a larger number of parallel fibres;

2. The torsion coefficient can be appreciably reduced, thus obtaining less twisted fibres with a better swelling. One of the other criterions which was taken into consideration for securing the funnel to the disintegrator is that the spinning tension is reduced, thus removing an obstacle to the reduction of torsion;

3. The temperature due to friction of the yarn on the funnel can be reduced at such a degree that cooling becomes unnecessary.

In the practical embodiment of the invention, the opening-up member has a top inwardly-extending flange through which bolts or other securing means extend so as to secure it to a flange on the funnel and to a flange forming part of a sleeve which rotates around the outlet tube.

The funnel comprises a hollow element having a top securing flange which extends into the spinning chamber and which, along its central axis, has a tubular head terminating near the outlet tube.

The accompanying drawing shows a sectional view of the open-end spinning device according to the present invention.

The annexed drawing shows a device having a stationary casing 1,6, a fibre opener or opening-up member 2 and a spinning turbine 3 rotated by a vertical shaft 4.

Reference 5 denotes an exit tube for the yarn which is stationary and secured to the stationary casing which comprises the top spinning chamber 6 and the bottom spinning chamber 1.

According to the invention, the funnel shaped member 7 which will be described hereinafter is connected to opening-up member 2 (disintegrator) and rotates with it.

In known mammer the opening-up member has a bottom annular flange 8 which cooperates with an edge 9 of the inlet cone 10 to form a radial annular slot 11 having a tapering aperture and through which fibres are introduced into the spinning turbine 3, after being introduced at 17.

At its top end, the opening-up member 2 has an inwardly extending flange 12 through which bolts 13 extend so as to secure it to a flange 14 of the funnel 7 and to a flange 15 forming part of a sleeve 16 which rotates around the yarn outlet tube 5.

The shape given to the funnel-shaped member is an important feature.

This member 7 is a hollow element having a top flange 14 extending into the spinning chamber 18.

Along its central axis it has a tubular head 19 which terminates near the outlet tube 5.

The distance 20 between head 19 and the base of the outlet tube 5, which is bevelled, should be as small as possible (0.5 mm).

Experience has shown that the bottom 21 of the hollow member must be above the level of the bottom end of the annular lip or flange 8 of the opening-up member (the difference in level is represented by *h*) so that the ballooning fibres are brought into contact with the hollow member forming the funnel but do not touch the annular flange of the opening-up member.

As known, a cylindrical ring 22 having a rigid lining 23 (saw-tooth wire clothing) is provided outside the disintegrator 2.

According to another feature, the funnel 7 can be externally coated with a layer of a material such as a plasma $7^1$ so as to improve the stripping of the fibres and reduce the wear on the component.

As a result, the funnel-shaped piece can be made of light alloy.

What I claim is:

1. In an open-end spinning unit for producing yarn from fiber material, said unit comprising a casing having an inlet for the fiber material to be treated and an inlet cone with an edge, a spinning turbine having a circumferential portion to enclose a space in said casing in which said yarn is formed, an opening-up member rotatably mounted in said casing having a substantially cylindrical portion provided on its outer periphery with needle means and a bottom outwardly flaring flange cooperating with the said edge of the inlet cone to form a radial annular slot through which the fibers are introduced from the inlet into the spinning turbine after having been subjected to the needle means, an exit tube for the yarn formed connected with the casing, a sleeve rotatably mounted around the yarn exit tube, and a hollow funnel-shaped yarn guiding member projecting into said space in said turbine and means fixing said funnel-shaped guiding member to said opening-up member to rotate with the latter, the bottom of the funnel-shaped member being at a higher level inside the turbine than the end of the outwardly flaring flange of the opening-up member.

2. An open-end spinning unit according to claim 1, in which the said opening-up member has an inwardly-extending flange and the yarn guiding member has an outwardly extending flange, and means extending through both flanges are provided to secure together the said opening-up member and said yarn guiding member.

3. An open-end spinning unit according to claim 2 in which said sleeve is provided also with a flange, and means pass through said sleeve flange securing same to the yarn guiding member and to the opening-up member.

4. An open-end spinning unit according to claim 2, in which the yarn guiding member is a hollow element having along its central axis a tubular head which terminates near the yarn exit tube.

5. An open-end spinning unit according to claim 4, in which the yarn exit tube is bevelled inwardly, and the distance between the head of the yarn guiding member and the base of the yarn exit tube is as small as possible and of the order of 0.5 mm.

6. An open-end spinning unit according to claim 1, in which the yarn guiding member has an external coating of a material adapted to ensure improved stripping of fibers and to reduce the wear of the said member.

7. An open-end unit according to claim 6, in which said material is constituted by plasma.

* * * * *